United States Patent [19]

Kiehl

[11] 4,078,646

[45] Mar. 14, 1978

[54] INDEPENDENT INDEX MECHANISM FOR PARKING METERS

[75] Inventor: William C. Kiehl, Russellville, Ark.

[73] Assignee: POM Incorporated, Russellville, Ark.

[21] Appl. No.: 753,939

[22] Filed: Dec. 23, 1976

Related U.S. Application Data

[63] Continuation of Ser. No. 616,087, Sep. 23, 1975, abandoned.

[51] Int. Cl.[2] ..... G07F 3/02

[52] U.S. Cl. ..... 194/83; 194/DIG. 21

[58] Field of Search ..... 194/DIG. 21, DIG. 22, 194/19, 99, 102, 61, 83

[56] References Cited

U.S. PATENT DOCUMENTS

| | | | |
|---|---|---|---|
| 3,126,995 | 3/1964 | Kissinger et al. | 194/19 |
| 3,977,507 | 8/1976 | Kaiser | 194/99 |

*Primary Examiner*—Stanley H. Tollberg

*Attorney, Agent, or Firm*—Strauch, Nolan, Neale, Nies & Kurz

[57] ABSTRACT

A multiple coin sensing apparatus for a parking meter has an index which positions a stop pin in accordance with the diameter of the coin being cycled through the meter. The indexing mechanism comprises a disc which is provided with a groove for each coin to be accommodated into which grooves the stop pin is received upon rotation of the indexing mechanism. The amount of movement of the indexing mechanism is determined by the length of the groove with which the stop pin is aligned by the coin being cycled through the meter.

17 Claims, 10 Drawing Figures

INDEPENDENT INDEX MECHANISM FOR PARKING METERS

This is a continuation of application Ser. No. 616,087 filed Sept. 23, 1975, now abandoned.

BACKGROUND OF THE INVENTION AND SUMMARY OF THE PRIOR ART

This invention relates to means for sensing the value of a coin in a parking meter and for moving the time indicator across the time scale a distance corresponding to the value of the coin being cycled through the meter. It is conventional in prior art meters to sense the value of the coin by sensing its diameter. However, in prior art multiple coin meters a problem is encountered when it is desired to handle a series of coins in which the diameters of the coin do not serially correspond to the values of the respective coins, such as for example in the series composed for a penny, nickel, dime or nickel, dime, quarter. In order to overcome this problem it has been necessary in prior art meters to resort to relatively complex mechanisms such as that shown for example in U.S. Pat. No. 2,901,078. In such devices the accuracy of the sensing device is critical and may be subject to malfunction. Also in prior art meters such as that disclosed in U.S. Pat. No. 2,901,078 if a spurious coin of a size intermediate of the size of any two successive coins of a series it is designed to accommodate, is inserted in the meter, the meter will register the value of the next largest coin it is designed to accept and therefore an amount of time may then be registered which is beyond the value of the spurious coin.

Another approach to this problem is suggested in U.S. Pat. No. 3,126,995 to Kissinger et al. In the mechanism disclosed therein, a relatively large control disc having a series of slots each of the length corresponding to the value of the coins to be accepted by the meter is positioned in accordance with the size of the coin being cycled, to locate one of the slots in alignment with a pin. The pin is then free to move the length of the slot and in so doing move the indicator an appropriate amount corresponding to the value of the coin. The mechanism disclosed therein is also complex in that the member carrying the pin must be geared with the member carrying the indicator at a ratio to provide sufficient movement of the indicator to register the correct amount of the time by movement of the pin the distance permitted by the slot. Also the member containing the slots is relatively large and therefore requires a significant amount of force to position it in accordance with the diameter of the coin.

The invention herein overcomes these disadvantages by employing a simple, light-weight indexing arm to sense the value of the coin and which carries a pin which is located in alignment with an appropriate one of several grooves formed in the index disc, the groove being of proper length to allow movement of the disc and pointer an amount to register time corresponding to the value of the coin being cycled, through the meter.

OBJECTS OF THE INVENTION

Accordingly, it is an object of the instant invention to provide a relatively simple indexing mechanism employing a minimum of light-weight parts.

It is a further object of the invention to provide an indexing mechanism for a multiple coin meter which may be easily adapted to accommodate any series of coins regardless of their relative sizes and values.

It is a further object of the invention to provide a multiple coin meter having an indexing mechanism which will register only an insignificant amount of time for any spurious coins which may be cycled through the meter.

It is an additional object of the instant invention to provide an indexing mechanism for a multiple coin meter in which an indexing disc has a multiplicity of grooves of varying length to correspond with the value of the coins to be accommodated, the grooves being adapted to receive a pin positioned in alignment with an appropriate one of the grooves in accordance with the value of the coin whereby the index plate will drive an indicator the distance allowed by the length of the groove with which the pin is aligned.

Further objects of the invention will appear as the description hereinafter proceeds.

DESCRIPTION OF THE PREFERRED EMBODIMENT

Figure 1:
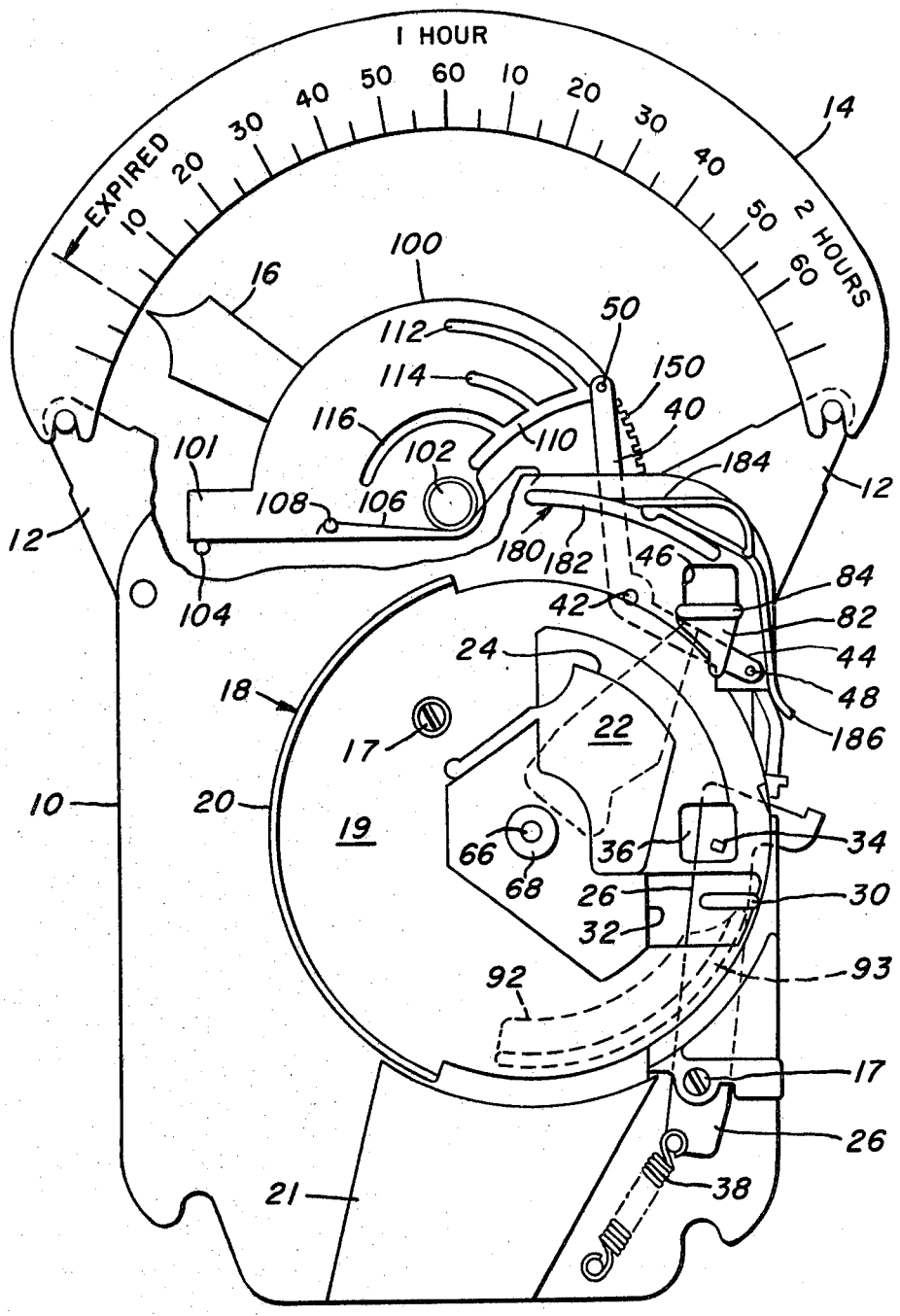
FIG. 1 is a front elevation drawing of the interior of a multiple coin parking meter showing certain elements of the coin cycling and indexing mechanism.

Referring to the drawings, FIG. 1 shows the coin handling and indexing mechanism of the meter embodying the instant invention, the coin rotator (shown in detail in FIG. 6) having been removed to expose certain of the elements which underlie the coin rotator in the assembly. A front plate 10 shown in detail in FIG. 2 has secured to its upper portion by means of arms 12 an arcuate time scale 14 with respect to which an indicator arm 16 is positioned by the mechanism hereinafter described to show the amount of time purchased by the coins cycled through the meter. A generally circular coin pan 18 having an upstanding arcuate portion 20 extending partially around the periphery of a central planar portion 19 is secured to front plate 10 by any suitable means such as screws 17. Spacers (not shown) are appropriately positioned on the rear surface of planar portion 19 so that when the coin pan 18 is mounted on plate 10 the rear surface of planar portion 19 is spaced from plate 10 to provide a space for certain of the coin sensing elements as hereinafter described. A coin cam 22 having an arcuate cam surface 24 may be integrally formed on the front of portion 19 or secured thereto by any suitable means such as by screws not shown.

A trip lever 26 is mounted between plate 10 and a portion of the rear surface of central portion 19 which is spaced from plate 10 whereby trip lever 26 is free to move in a plane parallel to the plane of plate 10 but is held between the rear surface of central portion 19 and plate 10 against movement in a direction perpendicular to the plane of plate 10. An elongated slot 28 (FIGS. 3 and 4) receives the shank of one of the screws 17 so that trip lever 26 is free to pivot about the shank of screw 17 or to move linearly by an amount that the length of slot 28 exceeds the diameter of the shank of screw 17. An abutment stop 30 projects from the upper surface of lever 26 through an opening 32 (FIG. 1) in central portion 19 of the coin pan and extends above the upper planar surface of the portion 19. Post 34 also projects from the upper surface of the lever 26 through an opening 36 in the portion 19 of coin pan and also extends above the upper planar surface of the portion 19. As shown in FIGS. 1, 3–5 one end of spring 38 is secured to the plate 10 and the other end is secured to the bottom portion of lever 26 so that the lever is biased downwardly. The position of screw shank 17 in slot 28 depends on the part of the cycle the mechanism is in as will be hereinafter described.

Figure 2:
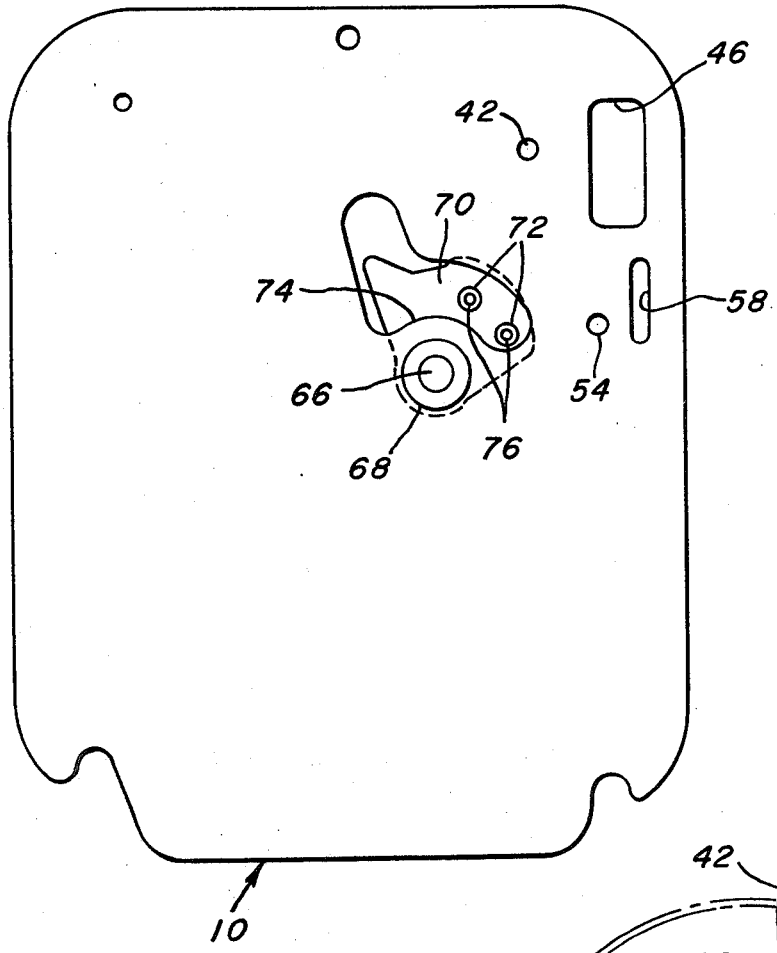
FIG. 2 is a front elevation view of the front mounting plate of the meter on which the various elements of the mechanism are mounted.
Figure 3:
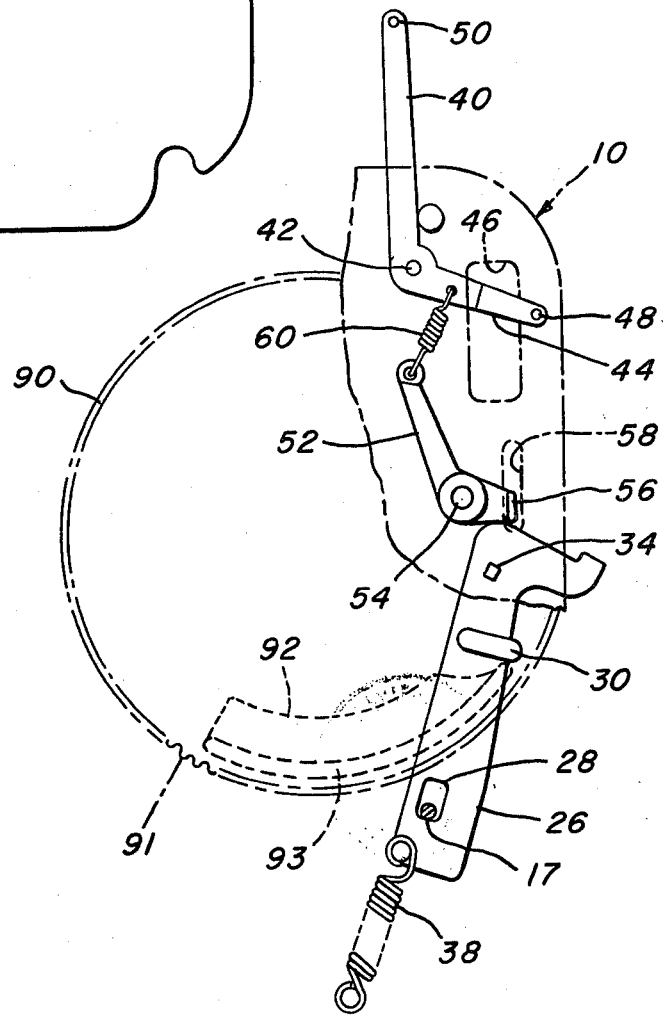
FIG. 3 is a view showing the relationship between the release arm and certain elements of the coin sensing mechanism before insertion of a coin.

Referring particularly to FIGS. 2 and 3, an index lever 40 is pivotally mounted to the rear of front plate 10 (a fragment of which is shown in phantom lines in FIG. 3) by means of a shaft 42 which is pivotally mounted between plate 10 and a rear plate (not shown) which is rearwardly spaced from plate 10. As shown in FIG. 3 index lever 40 is L-shaped in configuration and has a forwardly (as viewed in FIG. 3) offset portion 44 which projects through opening 46 in plate 10 so that portion 44 is positioned in front of plate 10 as viewed in FIGS. 1 and 3. A pin 48 projects forwardly from the end of offset portion 44. At the opposite end of lever 40 a pin 50 projects rearwardly from the end of lever 40. A bell crank shaped release arm 52 is also pivotally mounted to the rear of plate 10 by means of a shaft 54 which is pivotally mounted and extends between front plate 10 and the rear plate. The right end of release arm 52 as viewed in FIG. 3 has a forwardly projecting ear 56 which extends forwardly through an opening 58 in plate 10 a sufficient distance to be contacted by the top portion of trip lever 26 as shown in FIG. 3. A spring 60 extends between the upper end of release arm 52 and the index lever 40.

Referring to FIGS. 1, 2, 4 and 5 the forward end of a shaft 66 is pivotally mounted in front plate 10 (FIG. 2) by means of a bushing 68 received in a suitable opening in the front plate 10. The rear end of shaft 66 is pivotally mounted in the rear plate which is not shown.

Figure 4:
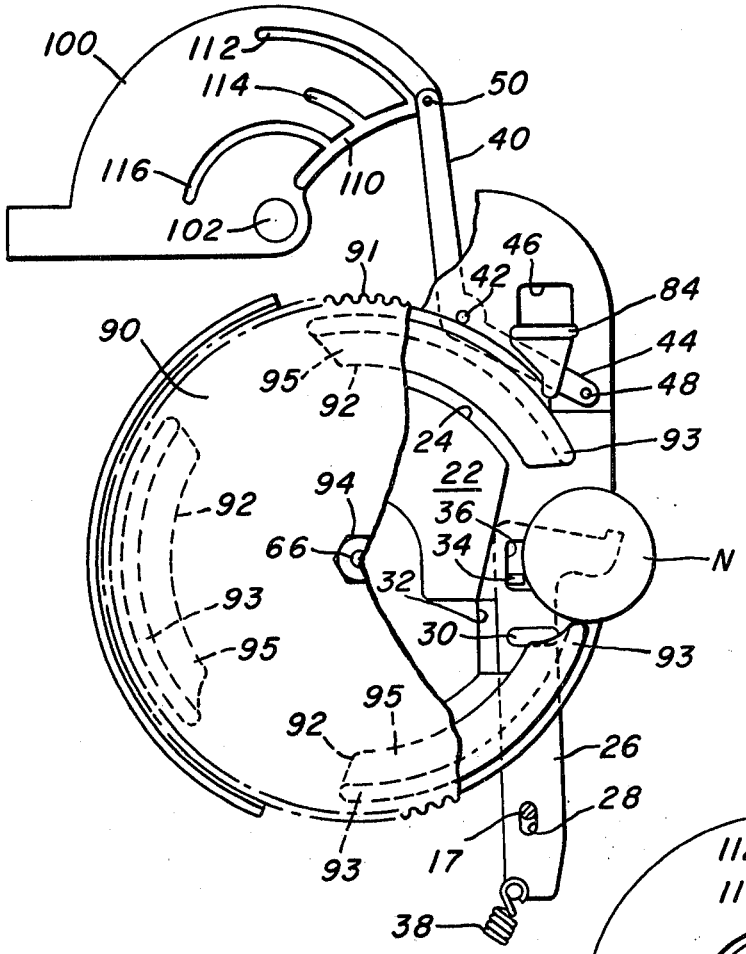
FIG. 4 is a view showing the relationship between certain elements of the coin cycling mechanism, and certain elements of the index mechanism at the point of coin insertion into the meter.
Figure 5:
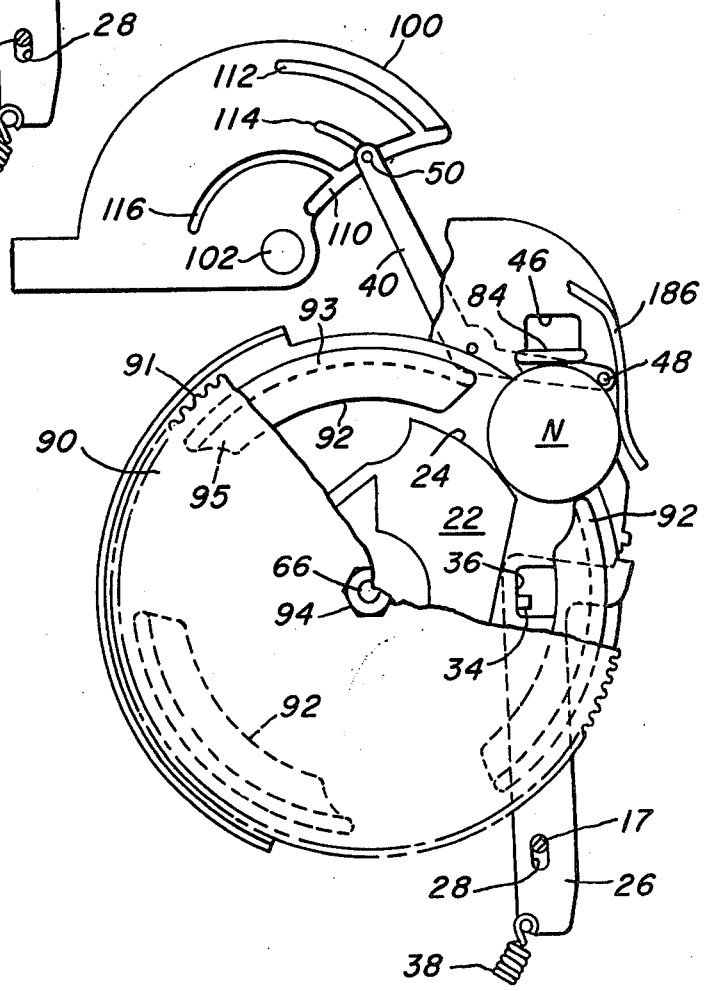
FIG. 5 is a view of the elements of FIG. 4 after the coin has been moved partly through the coin cycle and showing its engagement with the reset lever.
Figure 6:
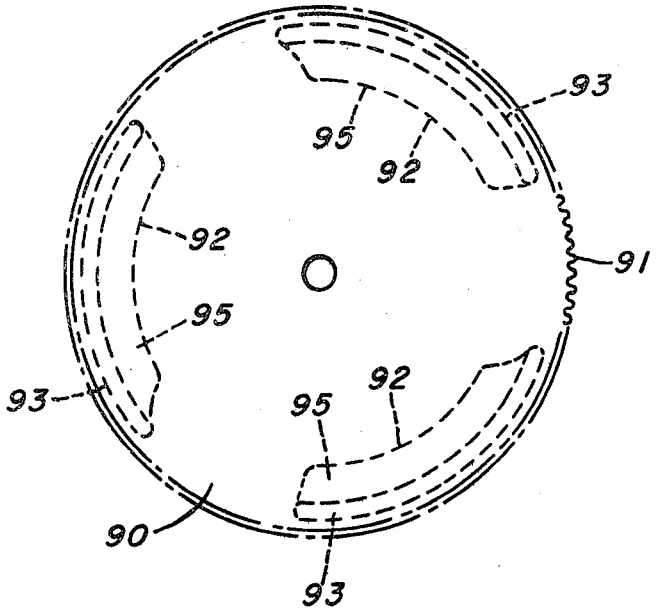
FIG. 6 is an elevation view of the coin rotator.

FIG. 6 shows a coin rotator 90 which is also shown in outline form in FIG. 3 and partly cut away in FIGS. 4 and 5. On the underside of the coin rotator 90 and fixed thereto are three arcuate coin drive sectors 92 which are equidistantly spaced from each other adjacent the periphery of the coin rotator 90. The sectors 92 are comprised of a main flat portion 95 and a rib 93 along the outer periphery of the sectors and which projects rearwardly beyond the plane of main portion 95. Teeth 91 are formed around the periphery of the coin rotator. In the assembly as shown in FIGS. 4 and 5 the rotator 90 is secured on shaft 66 for rotation therewith by means of a nut 94 threaded onto the threaded end portion of shaft 66. The coin rotator 90 therefore overlays the coin pan 18 in such a manner that the flat portions 95 of sectors 92 occupy the same plane as coin cam 22. Thus as the coin rotator 90 is rotated with shaft 66 the coin drive sectors 92 engage the coin inserted into the meter to cycle it through the coin sensing mechanism as will be more fully described hereinbelow.

Figure 7:
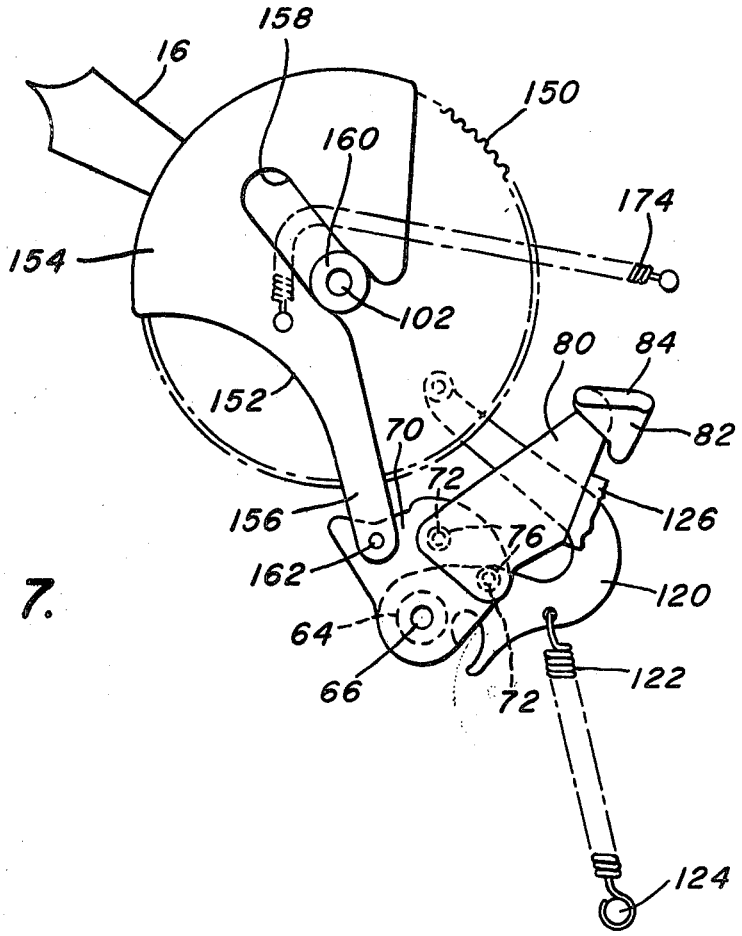
FIG. 7 is a view showing the relationship between the reset lever and certain other elements of the coin indexing mechanism.
Figure 8:
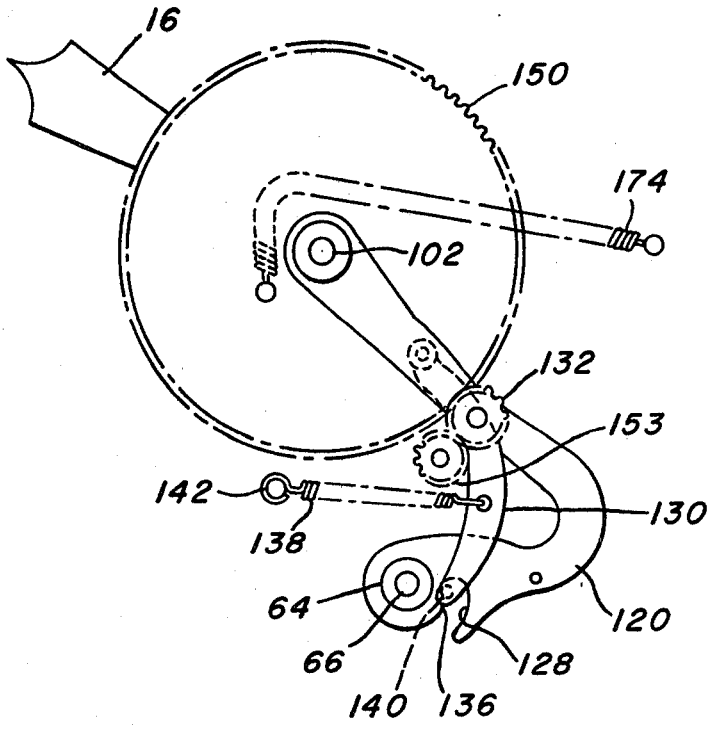
FIG. 8 is a view showing the relationship between the indicator gear, reset cam and idler arm all of which are components of the indexing mechanism.
Figure 9:
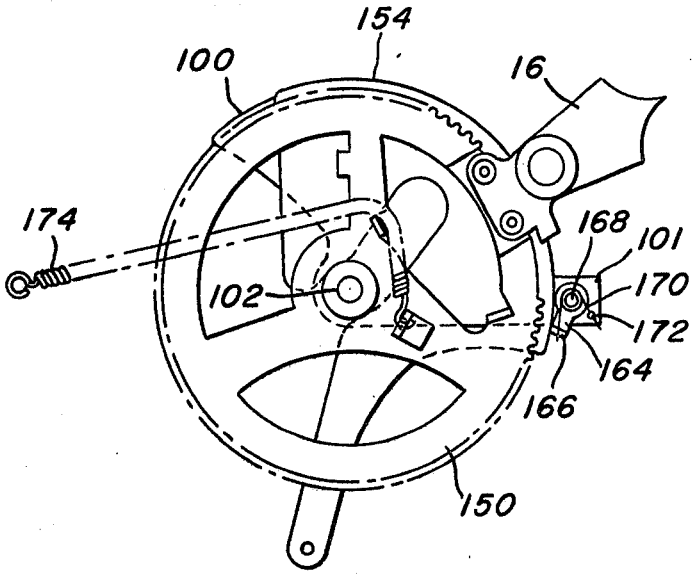
FIG. 9 is a view of the indexing gear and the masking cam viewed from the rear of the meter as shown in FIGS. 8–8.

Thus far has been described the coin sensing and handling mechanism. The indexing mechanism will now be described and for this purpose particular reference will be had to FIGS. 1, 7, 8, 9 and 10. Except for reset lever 80 the components of the indexing mechanism shown in these figures are all located to the rear of plate 10 as viewed in FIG. 1. FIGS. 7 and 8 are shown viewed from the same direction as FIG. 1 with front plate 10 and the coin cycling mechanism being removed. FIG. 9 however, shows certain elements of the indexing mechanism as viewed from the rear of the meter as shown in FIG. 1. Directly to the rear of plate 10 and occupying substantially the same plane as pin 50 a quadrant shaped index disc 100 is rotatably mounted on a shaft 102 which extends between plate 10 and the rear plate. As shown in FIG. 1 in its home position disc 100 is lightly biased against a pin 104 extending between plate 10 and the rear plate by means of a spring 106 coiled around shaft 102 and which has one end secured to a pin 108 on the disc 100 and the other end anchored to plate 10 as shown. A radially extending slot 110 is formed in the surface of index disc 100 continguous to the extreme right radially extending edge of the disc. Extending from and communicating with groove 110 are spaced arcuate grooves 112, 114 and 116 all of which are concentric to the axis of shaft 102. As best shown in FIG. 7 a sector shaped reset plate 70 and a cam arm 120 are connected for movement together by a hub 64 which is journalled on shaft 66 to the rear of plate 10 so that plate 70 and cam arm 120 move as a unit about the axis of shaft 66. Two internally threaded studs 72 project forwardly from plate 70 through arcuately shaped opening 74 in plate 10 (FIG. 2).

Referring to FIGS. 1 and 7, one end of a reset lever 80 is secured to the studs 72 on plate 70 by means of screws 76 and since the studs 72 project through opening 74, reset lever 80 overlies plate 10 and for the most part is contained within the space between the rear surface of central portion 19 of coin pan 18 and top plate 10. The opposite end of reset lever 80 has a triangular shaped ear 82 adjacent the periphery of the coin pan 18 but projecting forwardly slightly so that portion 82 occupies substantially the same plane as portion 19 of coin pan 18. Projecting forwardly from ear 82 is a coin engaging lug 84.

The entire subassembly consisting of reset plate 70, reset lever 80, cam 120 is biased in a clockwise direction by means of a spring 122, one end of which is secured to cam arm 120 and the other end of which is secured to a pin 124 extending rearwardly from plate 10. Thus the entire subassembly comprised of the plate 70, reset lever 80 and cam arm 120 is normally held in the position shown in FIG. 7 where reset arm 80 abuts against a stop surface 126 a portion of which is shown in FIG. 7 formed on the rear surface of coin pan 18 to prevent further clockwise movement of the subassembly from the position shown in FIG. 7. However, the subassembly is free to rotate in the counterclockwise direction against the tension of spring 122.

Referring to FIG. 8 a generally arcuate shaped idler arm 130 has rotatably mounted thereon approximately midway its ends an idler gear 132. The upper end of arm 130 is journalled on shaft 102 whereby the idler arm 130 may be rotated in a clockwise direction against the pressure of a spring 138 one end of which is connected to the idler arm and on the other end of which is connected to a pin 142 extending rearwardly from the back of plate 10. The lower end of arm 130 has a rearwardly extending pin 140 which projects into an arcuate opening 128 formed in cam arm 120. In the home position of the mechanism as shown in FIG. 8, pin 140 is biased against the closed end of opening 128. However, as the arm 120 is caused to rotate in a counterclockwise direction about the axis of shaft 66, the pin 140 is caused to ride up on nose portion 136 of the arm 120, which in turn causes the idler arm 130 to rotate in a counterclockwise direction about shaft 102 against the pressure of spring 138. An index gear 150 is journalled for rotation on shaft 102 rearwardly of index disc 100 but forwardly of idler arm 130. In the home position of idler arm 130, idler gear 132 engages index gear 150 and spur gear 153 which is driven by the clock mechanism not shown. A masking cam 152 comprised of a generally sector shaped portion 154 and a leg portion 156 is mounted between index gear 150 and index disc 100 on hub 160 formed on the front portion of index gear 150 by means of slot 158 in sector portion 154 which guides the masking cam 152 for generally vertical movement thereon. The extreme lower end of leg portion 156 is pivotally connected to reset plate 70 by means of a pin 162 as best shown in FIG. 7.

When the mechanism is in its home position as shown in FIG. 7, the sector portion 154 overlays a portion of the index gear 150 and in that position the periphery of the sector portion 154 is slightly above the teeth of index gear 150. As the reset lever 80 is rotated in a counterclockwise direction (as viewed in FIG. 7) about the axis of shaft 66, due to the pivotal engagement between the leg portion 156 and plate 70, the sector portion 154 is guided in downward movement by the hub 160 and slot 158 to a point where the periphery of the sector portion 154 is beneath the periphery of the index gear 150 and the teeth of index gear are exposed.

Figure 10:
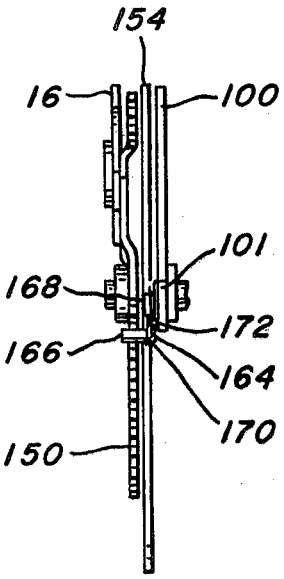
FIG. 10 shows the elements of FIG. 9 viewed from the right in FIG. 9.

FIG. 9 shows a portion of the indexing and indicator mechanism comprised of the index gear 150 and masking cam 152 as viewed from the rear of the meter shown in FIG. 1, while FIG. 10 shows the elements of FIG. 9 viewed from the right of FIG. 9. As shown, a pawl 164 is mounted for pivotal motion on a pin 168 projecting from the rear of ear portion 101 of the indicator disc 100. The pawl 164 has a rearwardly extending arm 166 which overlies the peripheries of index gear 150 and masking cam 152. Pawl 164 is biased in a clockwise direction as viewed in FIG. 9 against the periphery of masking cam 152 by a spring wound around pin 168, one end of said spring projecting through arm 166 the other one being retained by pin 172 which also projects rearwardly from ear portion 101. With the elements in the position shown in FIG. 9, arm 166 contacts the periphery of sector portion 154 of masking cam 152 and since the periphery of sector portion 154 is above the teeth of index gear 150, arm 166 is held out of engagement with the teeth of index gear 150.

Referring again to FIG. 1 a coin guard 180 comprising an arcuate wall 182 and a resilient leaf 184 is secured to wall 10 adjacent but spaced from the upper periphery of coin pan 18. The curvature of wall 182 corresponds to the curvature of cam surface 24. One end of a resilient L-shaped squeeze arm 186 is received in a socket formed at the juncture of wall 182 and leaf 184. As shown in FIG. 5 a coin N on cam surface 24 will be contacted by arm 186 and firmly pressed against the cam surface by the resiliency of arm 186 and leaf 184.

The various elements of the coin handling and indexing mechanism having been described, the operation thereof will now be described. FIG. 1 shows the position of the various elements before insertion of a coin and with no time on the meter. As previously explained, the coin rotator 90 is secured for rotation with shaft 66 by means of a nut 94 (FIGS. 4 and 5). In this condition the coin rotator 90 is being urged in a counterclockwise direction by the clock spring but as shown in dotted line form in FIGS. 1 and 3 the leading end of rib 93 of one of the segments 92 is engagement with lug 30 of trip lever 26 and therefore the coin rotator 90 and shaft 66 are held against any movement until a coin is inserted into the meter. The trip lever 26 is held against further upward movement by engagement of pin 17 with the bottom of slot 28 and the top portion of lever 26 engages ear 56 of release arm 52.

FIG. 4 shows the elements of the coin cycling mechanism at the point of coin insertion. At this point a coin N, for example a nickel, is inserted into the meter from the right of the mechanism shown in FIG. 4. The first thing that happens is that the coin, under the influence of manual pressure from the person inserting the coin, engages post 34 on lever 26 and causes the lever 26 to rotate in a counterclockwise direction about pin 17 to the point where lug 30 clears rib 93 and allows the shaft 66 and the coin rotator 90 to move in a counterclockwise direction under the influence of the clock spring. At the same time lever 26 is pulled downwardly by spring 38 until pin 17 engages the top of slot 28, thereby disengaging the top of lever 26 from ear 56 of release arm 52. The rate of rotation of the coin rotator 90 is controlled by a governor which engages gear teeth 91 on the periphery of the coin rotator in the manner disclosed in U.S. Pat. No. 2,901,078.

The coin N is engaged by the leading end of one of the sectors 92 and is carried around by the coin rotator 90 in the space between the coin rotator and the surface 19 of the coin pan 18 until it rides up on cam surface 24. As the coin rides up on cam surface 24 it is engaged by resilient squeeze arm 186 which insures that the coin is firmly seated against the surface 24 of the cam 22. With continued movement of the coin as shown in FIG. 5 it next engages pin 48 and depending on the diameter of the coin, as the coin continues to move along the surface 24, index lever 40 is rotated about its pivot to align rearwardly projecting pin 50 with one of the slots 112, 114 or 116. When coins of a relatively large diameter are to be accommodated, the wall 182 of coin guard 180 prevents the coins from being displaced upwardly as they are cycled through the meter. In the case of the nickel, the diameter of the coin is such that the pin is aligned with groove 114. In this position since the lever 26 is held in its lowermost position as shown in FIG. 5, the upper portion of lever 26 will no longer engage ear 56 of lever 52 and lever 52 will be free to rotate in a clockwise position as viewed in FIG. 3 to allow index lever 40 to rotate in a counterclockwise motion without any restraint. Therefore, until the lever 26 is returned to its uppermost position as shown in FIGS. 1 and 3, levers 52 and 40 will remain in the position they were placed by the engagement of the pin 48 with the coin N.

After lever 40 has been so positioned to align pin 50 with groove 114, as the coin N is moved along the surface 24 it next engages ear 84 of reset lever 80 and reset plate 70 are rotated in a counterclockwise direction as viewed in FIG. 7 which causes masking cam 152 to be pulled downwardly guided by hub 160 in slot 158 until the periphery of the sector portion 154 of the masking cam is beneath the periphery of the index gear 150, whereby ear 166 of pawl 164 is allowed to engage the teeth of the index gear 150 (FIGS. 9 and 10). At the same time cam 120 is rotated in a counterclockwise direction (FIG. 8) causing pin 140 on idler arm 130 to ride up on nose portion 136 of cam arm 120 whereby idler arm 130 is rotated about the axis of shaft 102 to disengage idler gear 132 from clock driven gear 153, thereby freeing index gear 150 for movement under the influence of spring 174 in a clockwise direction as shown in FIGS. 1, 7 and 8. Therefore when the reset lever 80 is engaged and rotated by the coin, masking cam 150 is retracted to connect the index disc 100 with the index gear 150 through pawl 164 and at the same time idler gear 132 is disconnected from the clock driven gear 153 and the assembly of the index disc 100 and the index gear 150 are free of the clock drive and can be rotated under the influence of spring 174 which is sufficiently strong to overcome the bias of spring 106. The index disc 100 and index gear 150 will then be rotated to a position where the end wall of groove 114 abuts up against pin 50 on the index arm 40. As explained above groove 114 is of a length which will permit travel of the index gear 150 and the pointer 16 a sufficient distance to register the amount of time corresponding to a nickel.

As the coin continues its travel through the mechanism it disengages ear 84 of reset lever 80, drops down off the surface 24 of the cam 22 and is ultimately discharged from the space between the coin pan 18 and coin rotator 90 into a coin slot 21 which conducts it to a coin box not shown. When ear 84 is disengaged by the coin the entire subassembly comprised of the reset lever 80, reset plate 70, cam 120 rotates in a clockwise direction as viewed in FIG. 7 under the influence of spring 122 to the position shown in FIG. 7 and 8 and the idler arm 130 is returned to the position shown in FIG. 8 by spring 138 which re-establishes the drive connection between the clock driven gear 153, the idler gear 132 and the index gear 150. At the same time the masking cam 152 is raised to the position shown in FIG. 7 to disengage pawl 164 from the teeth on the periphery of index gear 150. Index disc 100 is therefore at this point freed from the index gear 150 and is returned to its home position against stop 104 as shown in FIG. 1 under the influence of spring 106. The clock then slowly drives the gear 150 in a counterclockwise direction as viewed in FIG. 8 to return the index gear 150 and the pointer 16 to the zero time position shown in FIG. 1.

After the coin drops from surface 24 of cam 22 the coin rotator 90 continues to be rotated by the clock spring until the next succeeding segment 92 engages lug 30 on trip lever 26. The lever is then urged by the engagement of the segment 92 on the coin rotator 90 to its uppermost position where the pin 17 engages the bottom of slot 28 as shown in FIG. 3. At this point the lug 30 acts as a positive stop to the coin rotator preventing further motion thereof until another coin is inserted into the meter to displace the lever 26 and the lug 30 from engagement with the leading edge of that segment. Also when the lever 25 is urged to the position shown in FIG. 3 the top portion of the trip lever engages ear 56 on lever 52 and by means of spring 60 connected between lever 52 and lever 40, lever 40 is returned to its home position as shown in FIGS. 1, 3 and 4. The meter is now in condition for reception of another coin.

In the embodiment herein described groove 112 corresponds to a dime, groove 114 corresponds to a nickel and groove 116 corresponds to a quarter. When a dime is inserted into the meter the lever 40 will be rotated by engagement between the coin and pin 48 to position the pin 50 in alignment with slot 112 and the series of events which take place thereafter are the same as described above in connection with the nickel operation except that the length of slot 112 is such as will permit sufficient rotation of the indicator disc 100 and the index gear 150 in the manner above-described to position the pointer 16 opposite the point on scale 14 to show the proper amount of time corresponding to a dime. When a quarter is inserted into the meter, pin 50 will be positioned in alignment with groove 116 which is of sufficient length to allow the index gear 150 and pointer 16 to travel the necessary distance to be positioned opposite the amount of time corresponding to a quarter.

In the event a spurious coin having a diameter which does not correspond to the diameter of one of the coins which the meter is designed to accommodate, the pin 48 will of course be engaged by the coin as in the same manner as takes place in connection with legitimate coins. However, in this case the lever 40 will be rotated to a point where the pin 50 is not in alignment with any one of the grooves 112, 114 or 116 but instead will abut up against the side wall of radial slot 110 thus preventing any significant movement of the disc 100 when the reset lever is engaged. Therefore such coins will not allow any significant amount of time to be registered on the meter as in the case of some prior art meters hereinabove described which permit the registration of time corresponding to the value of the next larger coin. With reference to FIGS. 1, 4 and 5, slot 110 is actually formed as an arc which is a portion of the periphery of a circle which passes through or close to the axis of shaft 102 and the axis of which circle is substantially coincident with the axis of shaft 42, the distance between the pin 50 and shaft 42 being substantially the radius of the circle. With this relationship, when the pin 50 abuts against the side wall of slot 110 to act as a stop for disc 100, the force which the disc 100 applies to the pin 50 and lever 40 under the influence of spring 174 (FIG. 9) acts along a straight line passing through pin 50 and shaft 42. Thus this force is absorbed by the lever 40 without any tendency to rotate the lever about its pivot shaft 42. Without this relationship between the slot 110 and lever 40, the force applied to the lever 40 when the pin 50 abuts against the side wall of slot 110 would tend to rotate the lever about the axis of shaft 42 until the pin is aligned with one of the next adjacent grooves 112, 114 or 116 thereby causing the meter to show time when a spurious coin is inserted into it.

It can be seen that any reasonable number of grooves in the index disc 100 can be located at any radial distance from the axis of shaft 102 to accommodate coins of any desired diameter. Also a value of time to be purchased by each of the coins can be assigned to each coin simply by forming the grooves of appropriate length to permit registration of the desired amount of time on the meter. The meter thus affords a particularly flexible design in that multiple coins of any series can be accommodated without resort to complex mechanisms even though the size of the coins do not serially correspond to the value of the respective coins. While the embodiment herein described is adapted to accommodate the nickel-dime-quarter series, it will be appreciated that by suitable locations of the grooves and suitable dimensioning of the grooves any reasonable series of coins can be accommodated. This feature makes the meter particularly useful in foreign markets where many different series of coins are encountered. for example in Europe, since any reasonable series can be accommodated by simply providing an index disc 100 which has grooves located and sized to accommodate each series of coins in use in any particular country.

I claim:

1. A time-setting indexing mechanism for coin operated machines comprising: coin cycling means for moving a coin through a coin sensing cycle, time-setting indexing means, recess means formed in said indexing means and having a length proportionate to the value of the coin being cycled by said coin cycling means, coin sensing means having a stop member adapted to be received in said recess means and responsive to the size of said coin to move said stop member into alignment with said recess means remote from one end of the recess means, and means for moving said indexing means in a direction that receives said stop member in said recess means and through a distance limited by abutment of said stop member with said one end of said recess means, whereby the limit of movement of said indexing means is determined by the length of said recess means.

2. A time-setting indexing mechanism for a parking meter comprising: coin cycling means for moving coins of different denominations through a sensing cycle, time-setting indexing means, a plurality of recesses formed in said indexing means and having different lengths corresponding to different pre-selected denominations of coins to be cycled by said cycling means, coin sensing means for sensing the size of a coin being cycled by said cycling means, a stop member moved by said sensing means into alignment with different pre-selected ones of said recesses remote from terminations of said recesses depending upon the sensed size of the coin when the sensed coin size corresponds to one of said pre-selected denominations and means for moving said indexing means in a direction to receive said stop member in the recess with which it is aligned and through a distance limited by abutment of the stop member with the termination of the recess in which the stop member is received.

3. The time-setting indexing mechanism defined in claim 2 in which said indexing means comprises a rotatably mounted member, said recesses being formed in the surface of said rotatably mounted member.

4. The time-setting indexing mechanism defined in claim 3 in which said coin sensing means comprises a lever movable to a position corresponding to the size of the coin diameter.

5. The time-setting indexing mechanism defined in claim 3 in which said coin sensing means comprises a cam surface with which the edge of said coin is in contact when being cycled by said cycling means, and a pivotable lever having a part adapted to contact the edge of said coin at a point diametrically opposite the point where the edge of said coin is in contact with said cam surface to pivot said lever to a position corresponding to the diameter of said coin as said coin is cycled by said cycling means.

6. The time-setting indexing mechanism of claim 4 comprising holding means normally preventing movement of said indexing means from a home position, and reset means adapted to be actuated by the coin being cycled by said cycling means to release said holding means after said coin has actuated said coin sensing means.

7. The time-setting indexing mechanism of claim 6 in which said reset means comprises a movable reset lever in the path of movement of the coin being cycled by said cycling means, cam means movable with said reset lever, and release means actuated by said cam means to release said holding means upon movement of said reset lever and cam means as a result of movement of the coin by said cycling means.

8. The time-setting indexing mechanism defined in claim 4 wherein said rotatably mounted member and said lever are respectively rotatable about spaced axes, and wherein an arcuate abutment surface is formed on said rotatably mounted member and is contacted by said stop member when the latter aligns with none of said recesses to block movement of said rotatably mounted member in a time-setting direction, said abutment surface being formed along the periphery of a circle which passes in the region of the rotational axis of said rotatably mounted member, the center of said circle coinciding substantially with the axis of rotation of said lever.

9. A parking meter comprising a time-expiry indicator, cycling means for advancing a coin through a coin sensing cycle, time-setting indexing means connected to said indicator for setting said indicator to a parking time and comprising a member movable in a pre-selected direction to advance said indicator to a parking time and having a plurality of spaced apart openings each closed at one end, said openings having different lengths corresponding to different pre-selected coin sizes, stop means, sensing means for sensing the size of coins moved through said cycle and controlled by the size of the coin being moved by said cycling means to move said stop means into alignment with the one of said openings which corresponds to the sensed size of the coin when the coin size is one of said pre-selected sizes, and means for imparting movement of said member in said pre-selected direction to receive said stop means in the one of said openings with which it aligns, said movement of said member being limited by abutment of said stop means with the closed end of the one of said openings in which it is received.

10. A time-setting indexing mechanism for a parking meter comprising an indexing member mounted for rotation about a first axis, an indexing lever rotatable about a second axis spaced from said first axis, a stop on said lever, said indexing member having an abutment surface adapted to cooperate with said stop to prevent rotation indexing member in one direction, said abutment surface being formed along the arc of a circle which passes close to said first axis, the center of said circle being substantially coincident with said second axis.

11. A parking meter for receiving coins having different pre-selected sizes that determine their denomination and comprising means for moving each received coin through a coin sensing station, a time expiry indicator, time-setting means connected to said indicator and comprising an indexing member rotatable in a pre-selected direction to set said indicator to a parking time that is determined by the distance by which said indexing member is rotated in said pre-selected direction, means for rotating said indexing member in said pre-selected direction, sensing means for sensing the size of the coins moved through said station, said sensing means including a rockably mounted sensing member that is rocked about an axis through a distance corresponding to the size of a coin during movement of the coin through said station, and means comprising a plurality of first formations positioned on said indexing member to cooperate with said sensing member for limiting the rotation of said indexing member in said pre-selected direction to a distance corresponding to the denomination of the sensed coin size when the coin size is any one of said pre-selected sizes, said sensing member being engageable with an additional formation on said indexing member to prevent rotation of said indexing member in said pre-selected direction whenever the coin size sensed by said sensing means does not correspond to any one of said pre-selected sizes.

12. The parking meter defined in claim 11 wherein said sensing member is pivotally mounted in a position where it is engaged by the coins travelling through said station.

13. The parking meter defined in claim 11 wherein said first formations are curved to extend along concentric circles of different diameters, said circles having centers coincident with the rotational axis of said indexing member, and each of said first formations having a length corresponding to the denomination of a different one of said pre-selected coin sizes, said sensing member having stop means which is positioned by the rocking displacement of said sensing member to be engaged by the one of said first formations whose length corresponds to the sensed coin size for limiting rotation of said indexing member in said pre-selected direction.

14. The parking meter defined in claim 13 wherein said additional formation transversely intersects said first formations.

15. The parking meter defined in claim 14 wherein said first and additional formations are integral with said indexing member.

16. The parking meter defined in claim 14 wherein said first formations are grooves which are formed in said indexing member, each of said grooves having one end open at said additional formation and a closed end remote from said one end and engageable with said stop means to limit rotation of said indexing member in said pre-selected direction.

17. The parking meter defined in claim 13 wherein said sensing member is formed with first and second intersecting lever arm portions and is pivotal about an axis located at the intersection of said lever arm portions, each of said lever arm portions having a free end remote from the intersection of said arm portions, said stop means being on the free end of said first arm portion, and means positioned on the free end of said second arm portion and located to be engaged by the edge of a coin travelling through said station.

* * * * *